US010993016B2

(12) United States Patent
Kolton

(10) Patent No.: US 10,993,016 B2
(45) Date of Patent: Apr. 27, 2021

(54) EARPHONE WITH MODULAR EARFIN AND EARHOOK FITTINGS

(71) Applicant: Timothy Val Kolton, Los Angeles, CA (US)

(72) Inventor: Timothy Val Kolton, Los Angeles, CA (US)

( * ) Notice: Subject to any disclaimer, the term of this patent is extended or adjusted under 35 U.S.C. 154(b) by 0 days.

(21) Appl. No.: 16/189,867

(22) Filed: Nov. 13, 2018

(65) Prior Publication Data

US 2020/0154196 A1 May 14, 2020

(51) Int. Cl.
*H04R 1/10* (2006.01)

(52) U.S. Cl.
CPC ..... *H04R 1/1066* (2013.01); *H04R 1/105* (2013.01); *H04R 1/1016* (2013.01)

(58) Field of Classification Search
CPC .... H04R 1/1066; H04R 1/105; H04R 1/1075; H04R 1/1016; H04R 1/1058; H04R 5/0335
See application file for complete search history.

(56) References Cited

U.S. PATENT DOCUMENTS

2002/0012441 A1* 1/2002 Matsunaga ..... A42B 1/245 381/381
2006/0147078 A1* 7/2006 Neu ..... H04R 1/105 381/374
2016/0066079 A1* 3/2016 Kolton ..... H04R 1/1058 381/380
2017/0195770 A1* 7/2017 Cheney ..... H04R 1/1025

OTHER PUBLICATIONS

Manuals Lib, V-Mod BassFit Quick Start Manual, Mar. 15, 2018, pp. 1-3 (Year: 2018).*

* cited by examiner

*Primary Examiner* — Fan S Tsang
*Assistant Examiner* — Angelica M McKinney
(74) *Attorney, Agent, or Firm* — Edwin Tarver

(57) ABSTRACT

An earphone includes a body portion and a sound port, with the sound port including an earhook attachment located adjacent the body portion, an earfin attachment located adjacent the earhook attachment, and an ear tip adjacent the earfin attachment. An earhook is provided which engages the earhook attachment adjacent the body portion. An earfin includes an earfin aperture, which engages the earfin attachment when the sound port portion is inserted through the aperture. The earfin is configured such that when the tip is attached to the sound port, the tip extends beyond the earfin, opposite the body portion.

20 Claims, 7 Drawing Sheets

EARPHONE WITH MODULAR EARFIN AND EARHOOK FITTINGS

BACKGROUND

The present apparatus generally relates to personal sound systems. More specifically, the present invention relates to insertable earphones having modular attachments.

Insertable earphones are known in the art and, unlike headphones which cover a user's ears entirely, are designed to occlude the user's ear canal to provide isolation from surrounding environmental sounds. Earphones are preferable to headphones in many ways. Due to their small size, they lack the necessity of a headband or similar structure, relying instead on the pressure fit between the earphone and a user's ear canal to remain in place.

A problem exists, however, in that users engaging in strenuous, or movement-heavy physical activities can frequently move sufficiently erratically to dislodge an earphone despite its pressure fit. This requires the user to stop the activity and re-insert the earphone, and hamper's the user's ability to perform the physical activity to a desired extent of movement. To counter the problem of dislodging, various apparatus have been developed, including earfins and earhooks. Earfins typically extend from just behind the inserted tip of an earphone, engaging a user's middle ear just outside the ear canal, while earhooks extend around the back of the user's ear to hold an earphone in position. In the current art, there exist either earphones having an earfin, or having an earhook, and thus there exists a lack of customizability in response to different user preferences.

Hence, what is needed is an earphone that provides both an earfin and an earhook, and more specifically, there is a need for an earphone that provides both an earfin and an earhook, which can be individually and independently installed, used and removed according to user preference.

SUMMARY

An earphone apparatus for engaging a user's ear, in a first embodiment, may be characterized as having an earpiece, with the earpiece including a body portion and a sound port portion. The sound port portion includes an earhook attachment which is located adjacent the body portion, an earfin attachment which is located adjacent the earhook attachment, and a tip for inserting in a user's ear canal adjacent the earfin attachment.

An earhook is provided, and configured to engage the earhook attachment adjacent the body portion, and an earfin is provided independently of the earhook. The earfin preferably includes an earfin aperture, which is configured to engage the earfin attachment when the sound port portion is inserted through the aperture. The earfin is also configured such that when the tip is attached to the sound port, the tip extends beyond the earfin, opposite the body portion.

The earhook preferably engages the earhook attachment behind the earfin attachment, such that the earhook can be installed and removed independently of the earfin, and without interfering with installation and removal of the earfin.

In this first embodiment, the earhook attachment is formed as a stem extending from the body portion, with the stem including a tab for engaging the earhook. The earhook includes a bracket for engaging the earhook attachment, and the bracket has a notch for engaging a tab on the earhook attachment to hold the earhook in position. The earfin preferably includes a fin portion and an anchoring portion, and the earpiece includes a cowling for accommodating the anchoring portion in a pressure fit, with the cowling spaced away from the body portion. The apparatus also includes a cable for connecting the earpiece to a second earpiece.

In a second embodiment, the apparatus may be characterized as an earphone apparatus for engaging a user's ear, the earphone including a first earpiece and a complimentary second earpiece, with the first earpiece and second earpiece connected by a cable. The first earpiece and the second earpiece each have a body portion and a sound port, and each sound port includes an earhook attachment adjacent each body portion, an earfin attachment adjacent each earhook attachment, and a tip adjacent each earfin attachment;

A pair of earhooks is provided, each configured to engage one of the earhook attachments, preferably lateral to the body portion. A first earfin is provided, complimentary to the first earpiece, and a second earfin is provided, complimentary to the second earpiece. Preferably each earfin includes an earfin aperture, and each of the earfin apertures are formed such that they engage the earfin attachments when a sound port is inserted through an earfin aperture, such that the tips attached to the sound ports of the first earpiece and the second earpiece each extend beyond their respective earfins. Thus, the earhook and the earfin of each of the first earpiece and the second earpiece engage the earhook attachments behind the earfin attachments, such that the earhooks can be installed independently of, and without interfering with the earfins.

Similar to the first embodiment, the earhook attachments each have a stem extending from each of the body portions, and each stem includes a tab for engaging one of the earhooks, with each earhook having a bracket for engaging one of the earhook attachments, and each bracket having a notch for engaging a tab on one of the earhook attachments. Each of the earfins includes a fin portion and an anchoring portion, wherein the sound port of the first earpiece and the sound port of the second earpiece each comprise a cowling for accommodating the anchoring portion of one of the earfins in a pressure fit, with the cowlings spaced away from the body portions.

In a third embodiment, the apparatus may be characterized as an earphone having removable earhooks and removable earfins, each earphone including a body portion and a sound port portion, with the sound port portion comprising a cowling spaced away from the body portion by a stem. Each of the earhooks is configured to engage a stem in a manner that resiliently yet removably locks the earhook into a predetermined position. Each of the earfins includes an anchoring portion configured to engage the cowling in a pressure fit that resiliently yet removably locks the earfin into a user-selected position.

Thus the earhook engages the earhook attachment behind the cowling, such that the earhook can be installed independently of, and without interfering with installation and removal of the earfin. In this embodiment, a second earphone having substantially the same features is provided to create a conventional stereo earphone. In a preferred embodiment, the two earphones (i.e., the earphone and the second earphone) are connected by a cable.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
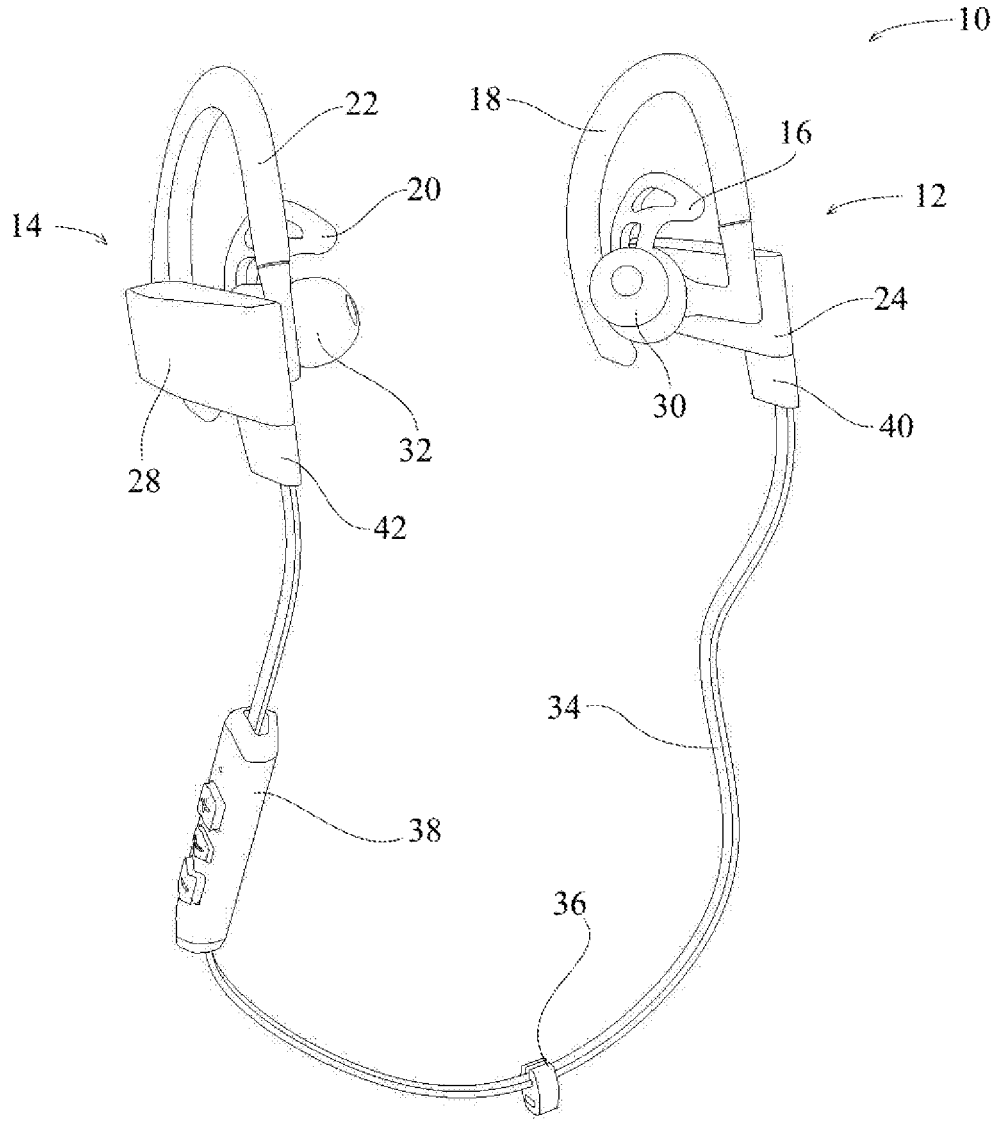
FIG. 1 illustrates a perspective view of a wireless modular earphone having earfin and earhook fittings, with an earfin and an earhook installed thereon.

Referring to FIG. 1, a wireless modular earphone 10 is shown including a first earpiece 12 and a second earpiece 14 with a first earfin 16 and first earhook 18, and a second earfin 20 and second earhook 22 attached thereto. The first earpiece 12 comprises a first body portion 24 and a first sound port portion 26 (FIG. ##). Likewise, the second earpiece 14 includes a second body portion 28 and a second sound port portion (not shown), which is preferably substantially similar to those of the first earpiece 12. The first earpiece 12 includes a first tip 30 for inserting into a user's ear, and the second earpiece 14 includes a second tip 32 for inserting into a user's ear, thereby allowing for high fidelity stereo sound production.

Figure 2:
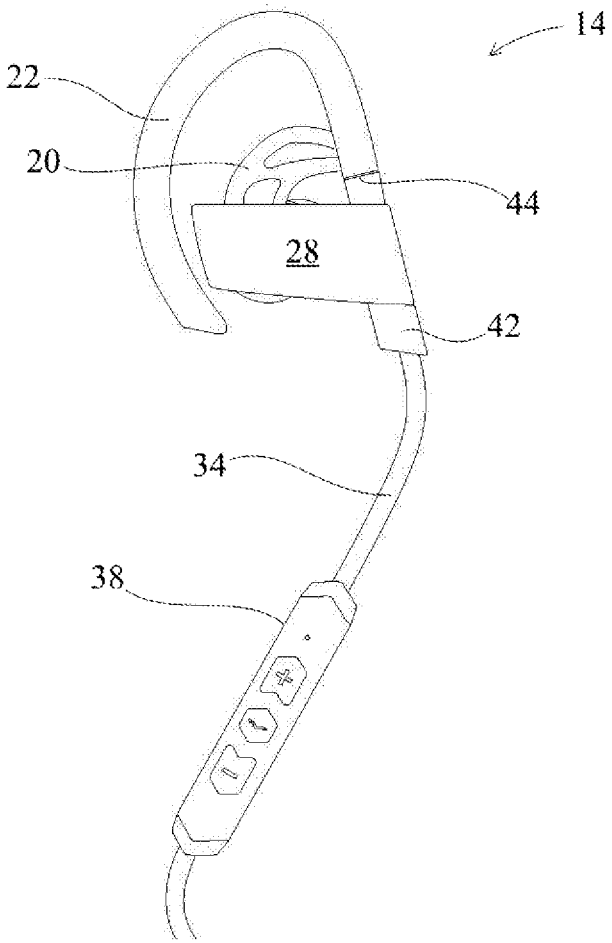
FIG. 2 illustrates a side view of a first earpiece of the earphone.

Still referring to FIG. 1, the first earpiece 12 and the second earpiece 14 are preferably connected together by a cable 34. The cable serves to anchor the first earpiece 12 to the second earpiece 14, and when draped around a user's neck, allows the earphone 10 to be worn around a user's neck when not in use. The cable 34 also prevents the earphone 10 from falling if either the first earpiece 12 or the second earpiece 14 become inadvertently dislodged. To assist with anchoring the earphone 10 to the user, and to prevent the cable 34 from engaging in undue movement during strenuous activity, a clip 36 is provided allowing a user to clip the cable 34 to an article of clothing, or similar worn article. Also preferably provided on the cable 34 is a controller, including the controls typically associated with interactive headphones, including start/stop and a volume control, in addition to a microphone for telephonic communication. Finally, a first cable sleeve 40 and a second cable sleeve 42 are preferably provided at the intersection of the cable 34 and the first earpiece 12 and the cable 34 and the second earpiece 14, in order to prevent undue stress on the cable Referring to FIG. 2, the second earpiece 14 is shown in side view, including the second body portion 28, and the attached second earfin 20 and second earhook 22. The cable 34 is also shown with the controller 38 in detail. In order to accurately fit a variety of ear sizes, second earhook 22 (and, preferably, the first earhook 18) may include a rotating hinge 44 that allows the second earhook 22 to swing relative to the second body portion 28 when installed thereon.

Figure 3:
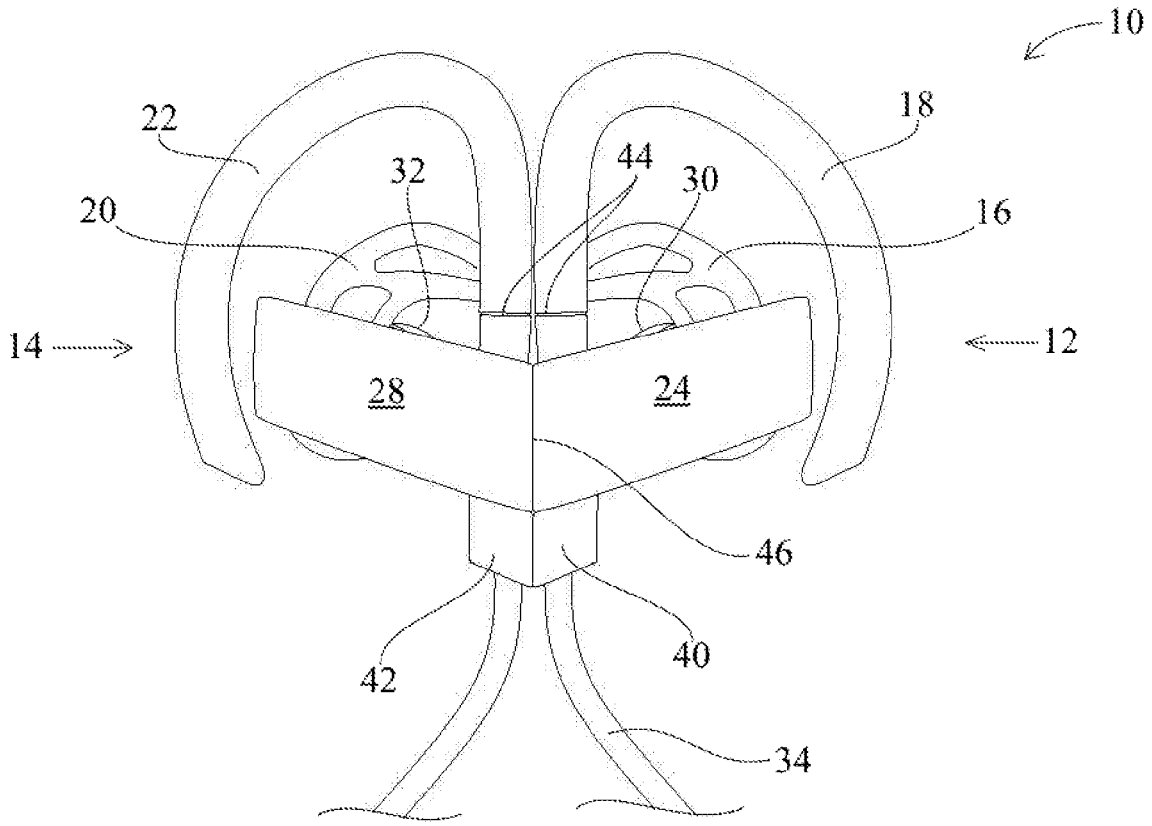
FIG. 3 illustrates a side view of a first earpiece and a second earpiece of the earphone magnetically connected together.

Referring to FIG. 3, the earphone is shown in a connected state for when not in use, such as during storage for example. Preferably, the first body portion 24 and the second body portion 28 each have magnetic edges 46 permitting them to be connected together for storage or carrying when not in use. The first cable sleeve 40 and the second cable sleeve 42, as well as the first earhook 18 and the second earhook 22, and the first earfin 16 and the second earfin 20 are also preferably arranged so that they do not interfere with the aligning of the first body portion 24 and the second body portion 28 along the magnetic edges 46.

Figure 4:
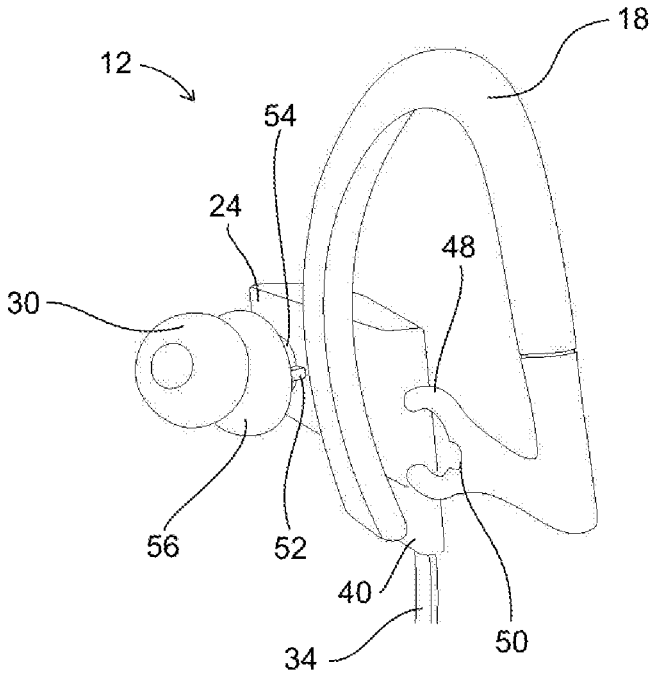
FIG. 4 illustrates an exploded view of the earphone with an earhook prior to being fitted onto the earhook fitting.

Referring to FIG. 4, the first earpiece 12 is shown with the first earfin 16 removed and the first earhook 18 in a first stage of assembly. In order to install the first earhook 18 on the first earpiece 12, a user begins by aligning the first earhook 18 relative to first earpiece 12, in the position it will assume when worn, but extended forward and away from the first earpiece. The first earhook 18 includes a bracket 48 for connecting the first earpiece 12. The bracket 48 is preferably semi-circular and open toward the earpiece 12. The bracket 48 also preferably includes a notch 50 opposite the portion open toward the earpiece 12. The notch is designed to engage a tab 52 extending from a stem 54 of the first earpiece 12, thus retaining the first earhook 18 in a manner that prevents the first earhook 18 from rotating around the stem 54 and falling out of alignment with the first earpiece 12.

The second earpiece 14 and the second earhook 22 also include these structures (i.e., bracket 48, notch 50, tab 52 and a second stem (not shown)) in a substantially similar form, such that installation of the second earhook 22 on the second earpiece 14 involves virtually the same steps. Also shown in this view is a cowling 56 onto which the first earfin 16 is installed. The cowling 56 is preferably extends from the stem 12, thus holding the cowling 56 away from the first earpiece 12 and thus providing space for the installation of the first earhook 22. The second earpiece 14 preferably includes a substantially similar cowling 56.

Figure 5:
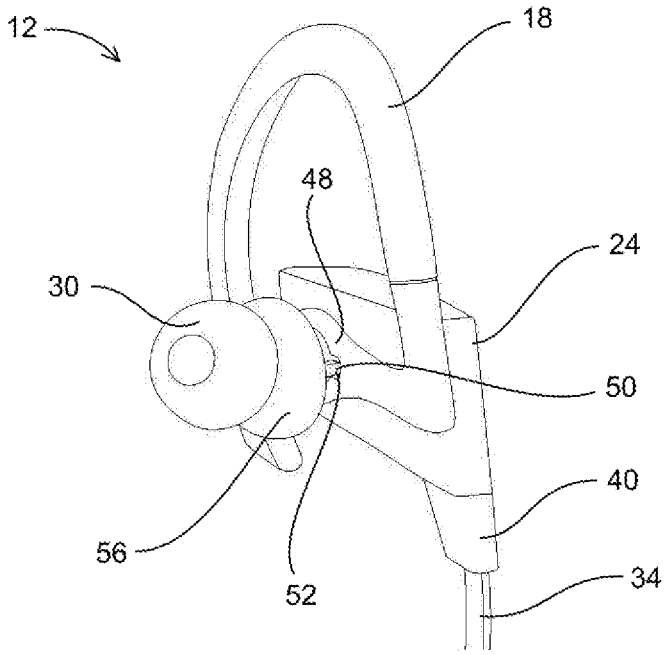
FIG. 5 illustrates a perspective view of the earphone with only the earhook installed thereon.

Referring to FIG. 5, The first earpiece 12 is shown with the first earfin 16 removed and the first earhook 18 in a second, final, stage of assembly. To complete installation of the first earhook 18 on the first earpiece 12, the first earhook 18 is moved toward the first earpiece 12 in the aligned position, such that the bracket 48 captures the stem 54. The first earhook 18 is preferably made of a resilient but deformable material that allows the bracket 48 to deform slightly as it travels around the stem 54. Since the first earhook 18 is aligned with the stem 54, as the stem 54 is captured in the bracket 48, the tab 52 is urged into the notch 50, thereby preventing the earhook from making any lateral, or rotational movement relative to the first earpiece 12.

Figure 6:
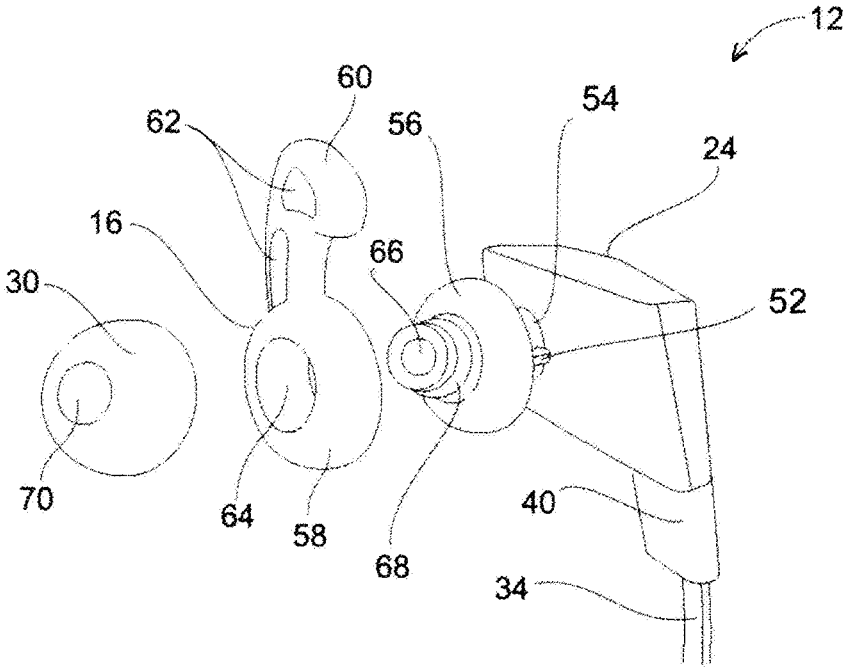
FIG. 6 illustrates an exploded view of the earphone with an earfin prior to being fitted onto the earfin fitting.

Referring to FIG. 6, the first earpiece 12 is shown with the first earhook 18 removed and the first earfin 16 in a first stage of assembly. In order to install the first earfin 16 on the first earpiece 12, a user begins by removing the first tip 30 to expose the first cowling 56. The first earfin 16 preferably includes an anchoring portion 58 and a fin portion 60. The anchoring portion 58 is preferably constructed of a resiliently deformable material, so that the anchoring portion 58 engages the first cowling 56 in a resilient pressure fit. Thus, the first earfin 16 is held in place once set in a preferred position by a user. The fin portion 60 may optionally include one or more fin ports 62 for decreased weight and/or for design purposes. The anchoring portion 58 also preferably includes an opening 64, provided to allow the sound port 66 and tip anchor 68 to extend through the earhook 18, and engage the first tip 30. The first tip 30 preferably includes an interior portion 70 allowing it to resiliently affix to the tip anchor 68.

Figure 7:
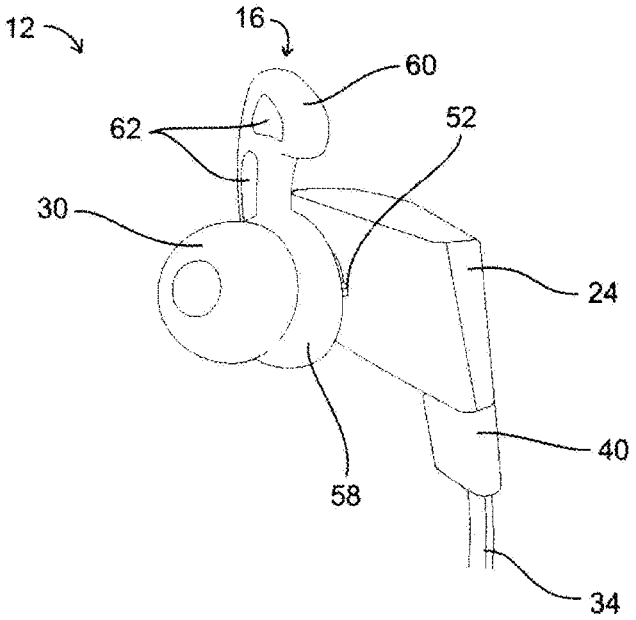
FIG. 7 illustrates a perspective view of the earphone with only the earfin installed thereon.

Referring to FIG. 7, the first earpiece 12 is shown with the first earhook 18 removed and the first earfin 16 in a second, final, stage of assembly. Installation of the earfin 16 is complete when the anchoring portion 58 is securely engaged around the first cowling 56, and the fin portion 60 is set in the preferred position, with the first tip 30 reinstalled on the first earpiece 12. The second earpiece 14 and the second earfin 20 also include these structures (i.e., anchoring portion 58, fin portion 60, optional fin ports 62, and opening 64) in a substantially similar form, such that installation of the second earfin 20 on the second earpiece 14 involves virtually the same steps. Because the first earhook 18 and second earhook 22 engage the first earpiece 12 and second earpiece 14 from the side, respectively, and because the first earfin 16 and the second earfin 20 engage the first earpiece 12 and the second earpiece 14 without obstructing the first earhook 18 and second earhook 22, the earhooks and earfins can be interchangeably affixed to the earpieces, either individually or in combination.

Figure 8:
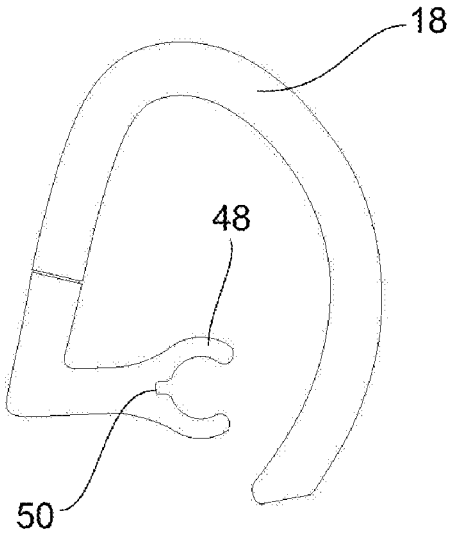
FIG. 8 illustrates a side view of the earhook.
Figure 9:
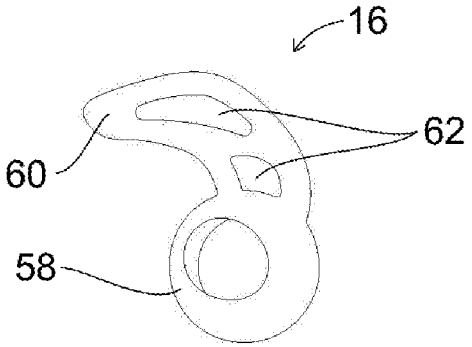
FIG. 9 illustrates a side view of the earfin.

Referring to FIG. 8, the first earhook 18 is shown by itself, including the bracket 48, and notch 50. The second earhook 22 is substantially identical to the first earhook 18, since the second earhook 22 affixes to the second earpiece 14 in substantially the same manner, and from substantially the same direction as the first earhook 18. Referring to FIG. 9, the first earfin 16 is shown by itself, including the anchoring portion 58, fin portion 60, fin ports 62 and opening 64. The second earfin 20 is similar in overall shape to the first earfin 16, but the fin portion 60 is in a reversed direction relative to the anchoring portion to account for the direction of the second earpiece 14 relative to a user's ear being the reverse of the first earpiece 12.

Figure 10:
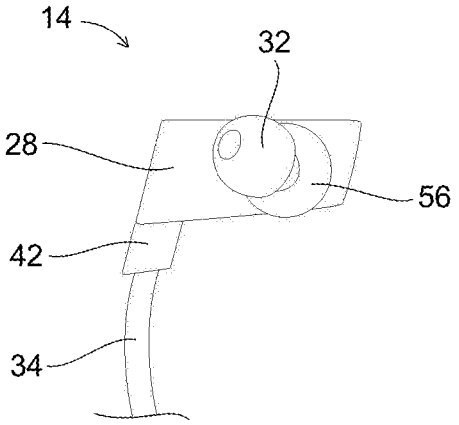
FIG. 10 illustrates a side view of the earphone without an earfin or earhook installed thereon
Figure 11:
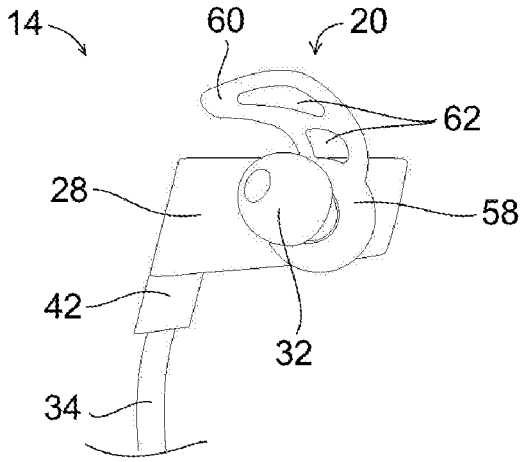
FIG. 11 illustrates a side view of the earphone with only the earfin installed thereon.
Figure 12:
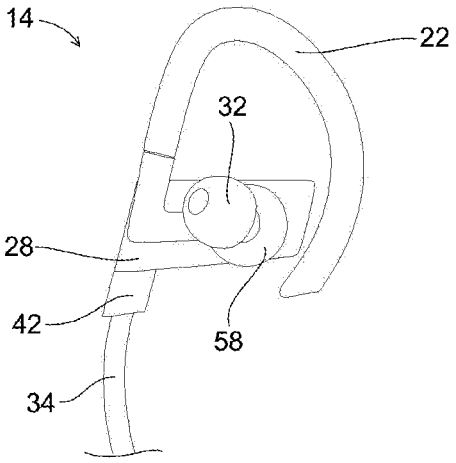
FIG. 12 illustrates a side view of the earphone with only the earhook installed thereon.
Figure 13:
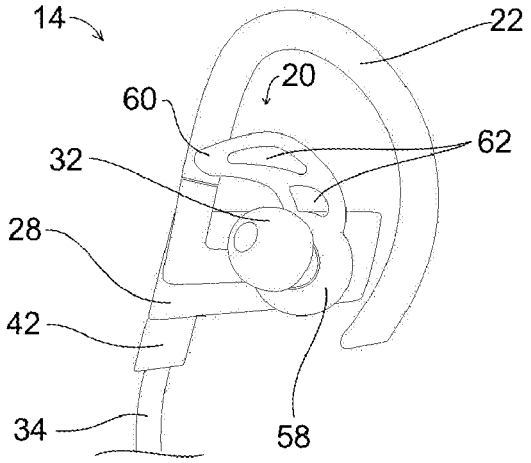
FIG. 13 illustrates a side view of the earphone with both the earfin and earhook installed thereon.

Referring to FIGS. 10-13, the second earpiece 14 is shown in various configurations according to user preference. FIG. 10 shows the second earpiece 14 alone, without the second earfin 20 or the second earhook 22 installed thereon. FIG. 11 shows the second earpiece 14 with only the second earfin 20 installed thereon. FIG. 12 shows the second earpiece 14 with only the second earhook 22 installed thereon. Finally, FIG. 13 shows the second earpiece 14 with both the second earfin 16 and the second earhook 18 installed thereon. Installations on the first earpiece 12 would be similarly executed, and these various installations may be made by a user independent of each other and according to preference. The installation of the first earfin 16 and the first earhook 18 (independently and alternatively) on the first earpiece 12 may be made in substantially the same manner.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An earphone apparatus for engaging a user's ear, the apparatus comprising:

an earpiece, the earpiece having a body portion and a sound port;

wherein the sound port comprises an earhook attachment adjacent the body portion, an earfin attachment adjacent the earhook attachment, and a tip adjacent the earfin attachment;

an earhook configured to engage the earhook attachment adjacent the body portion;

an earfin defining an earfin aperture, and configured to engage the earfin attachment when the sound port is inserted through the aperture, and further configured such that the tip attached to the sound port extends beyond the earfin;

wherein the earhook engages the earhook attachment behind the earfin attachment, such that the earhook can be installed independently of, and without interfering with installation and removal of the earfin.

2. The apparatus of claim 1 wherein the earhook attachment comprises a stem extending from the body portion.

3. The apparatus of claim 2 wherein the stem comprises a tab for engaging the earhook.

4. The apparatus of claim 2 further comprising a cable connecting the earpiece and a second earpiece.

5. The apparatus of claim 1 wherein the earhook comprises a bracket for engaging the earhook attachment.

6. The apparatus of claim 5 wherein the bracket comprises a notch for engaging a tab on the earhook attachment.

7. The apparatus of claim 1 wherein the earfin comprises a fin portion and an anchoring portion.

8. The apparatus of claim 7 wherein the earpiece comprises a cowling for accommodating the anchoring portion in a pressure fit.

9. The apparatus of claim 1 wherein the earpiece comprises a cowling spaced away from the body portion.

10. An earphone apparatus for engaging a user's ear, the apparatus comprising:

a first earpiece and a complimentary second earpiece, connected by a cable;

wherein the first earpiece and the second earpiece each comprise a body portion and a sound port;

wherein each sound port comprises an earhook attachment adjacent each body portion, an earfin attachment adjacent each earhook attachment, and a tip adjacent each earfin attachment;

a pair of earhooks configured to engage each earhook attachment lateral to the body portion;

a first earfin complimentary to the first earpiece and a second earfin complimentary to the second earpiece, and wherein each earfin comprises an earfin aperture;

wherein the earfin apertures are configured to engage the earfin attachments when the sound port is inserted through the earfin aperture, and further configured such that the tips attached to the sound ports of the first earpiece and the second earpiece each extend beyond their respective earfins; and wherein the earhook and the earfin of each of the first earpiece and the second earpiece engage the earhook attachments behind the earfin attachments, such that the earhooks can be installed independently of, and without interfering with the earfins.

11. The apparatus of claim 10 wherein the earhook attachments each comprise a stem extending from each of the body portions.

12. The apparatus of claim 11 wherein each stem comprises a tab for engaging one of the earhooks.

13. The apparatus of claim 10 wherein each earhook comprises a bracket for engaging one of the earhook attachments.

14. The apparatus of claim 13 wherein each bracket comprises a notch for engaging a tab on one of the earhook attachments.

15. The apparatus of claim 10 wherein each of the earfins comprises a fin portion and an anchoring portion.

16. The apparatus of claim 15 wherein the sound port of the first earpiece and the sound port of the second earpiece each comprise a cowling for accommodating the anchoring portion of one of the earfins in a pressure fit.

17. The apparatus of claim 10 wherein the first earpiece and the second earpiece each comprise a cowling spaced away from the body portion.

18. An earphone apparatus having a removable earhook and a removable earfin, the apparatus comprising:

a body portion and a sound port portion, the sound port portion comprising a cowling spaced away from the body portion by a stem;

the earhook configured to engage the stem in a manner that resiliently yet removably locks the earhook into a predetermined position;

the earfin having an anchoring portion configured to engage the cowling in a pressure fit that resiliently yet removably locks the earfin into a user-selected position;

wherein the earhook engages an earhook attachment behind the cowling, such that the earhook can be installed independently of, and without interfering with installation and removal of the earfin.

19. The apparatus of claim 18 further comprising a second earphone having the same features as the earphone.

20. The apparatus of claim 19 wherein the earphone and the second earphone are connected by a cable.

* * * * *